US007003844B1

(12) United States Patent
Mosby-Pinkney

(10) Patent No.: US 7,003,844 B1
(45) Date of Patent: Feb. 28, 2006

(54) CLOTHES LINT BALL REMOVAL SYSTEM

(76) Inventor: Judy Mosby-Pinkney, 1905 Trafalgar Dr., Ft. Washington, MD (US) 20744

( * ) Notice: Subject to any disclaimer, the term of this patent is extended or adjusted under 35 U.S.C. 154(b) by 49 days.

(21) Appl. No.: 10/857,676

(22) Filed: Jun. 1, 2004

(51) Int. Cl.
*A47L 13/12* (2006.01)
*A47L 25/08* (2006.01)

(52) U.S. Cl. ..... 15/104.002; 15/105; D04/116; D04/122

(58) Field of Classification Search ..... 15/104.002, 15/105; D4/116, 122; D32/42
See application file for complete search history.

(56) References Cited

U.S. PATENT DOCUMENTS

| | | | | |
|---|---|---|---|---|
| 3,906,578 | A | 9/1975 | Huber | |
| 4,905,337 | A | 3/1990 | McKay | |
| 5,077,856 | A | 1/1992 | Freundl | |
| 5,553,344 | A * | 9/1996 | Rosenkrantz | 15/104.002 |
| 2004/0052570 | A1 * | 3/2004 | McKay | 401/219 |

* cited by examiner

*Primary Examiner*—Mark Spisich

(57) ABSTRACT

A clothes lint ball removal system includes a handle member, an adhesive surface roller coupled to an end of the handle member, an arm extending from the handle member, and a razor coupled to a distal end of the arm.

5 Claims, 2 Drawing Sheets

CLOTHES LINT BALL REMOVAL SYSTEM

I. BACKGROUND OF THE INVENTION

The present invention relates to lint removers and more particularly pertains to a new clothes lint ball removal system for providing a single tool capable of removal of lint balls by either cutting or adhesion or a combination of both cutting and adhesion.

II. DESCRIPTION OF THE PRIOR ART

The use of lint removers is known in the prior art. U.S. Pat. No. 5,077,856 issued to Freundl on Jan. 7, 1992 describes a multiple blade manually operated cutting device for removing lint from clothing. Another type of lint remover is U.S. Pat. No. 4,905,337 issued to McKay on Mar. 6, 1990 disclosing an adhesive tape roller for removal of lint by adhesion. U.S. Pat. No. 3,906,578 issued to Huber discloses a lint remover having localized stubs.

While these devices fulfill their respective, particular objectives and requirements, the need remains for a single tool that provides lint removal through both cutting and adhesion.

III. SUMMARY OF THE INVENTION

The present invention generally comprises a handle member, an adhesive surface roller coupled to an end of the handle member, an arm extending from the handle member, and a razor coupled to a distal end of the arm.

There has thus been outlined, rather broadly, the more important features of a lint removal tool in order that the detailed description thereof that follows may be better understood, and in order that the present contribution to the art may be better appreciated. There are additional features of the lint removal tool that will be described hereinafter and which will form the subject matter of the claims appended hereto.

In this respect, before explaining at least one embodiment of the lint removal tool in detail, it is to be understood that the lint removal tool is not limited in its application to the details of construction and to the arrangements of the components set forth in the following description or illustrated in the drawings. The lint removal tool is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present lint removal tool. It is important, therefore, that the claims be regarded as including such equivalent constructions insofar as they do not depart from the spirit and scope of the present invention.

It is another object of the present invention to provide a lint removal tool which has all of the advantages of the prior art and none of the disadvantages.

It is another object of the present invention to provide a lint removal tool which may be easily and efficiently manufactured and marketed.

It is another object of the present invention to provide a lint removal tool which is of durable and reliable construction.

It is yet another object of the present invention to provide a lint removal tool which is economically affordable and available for relevant market segment of the purchasing public.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Figure 1:
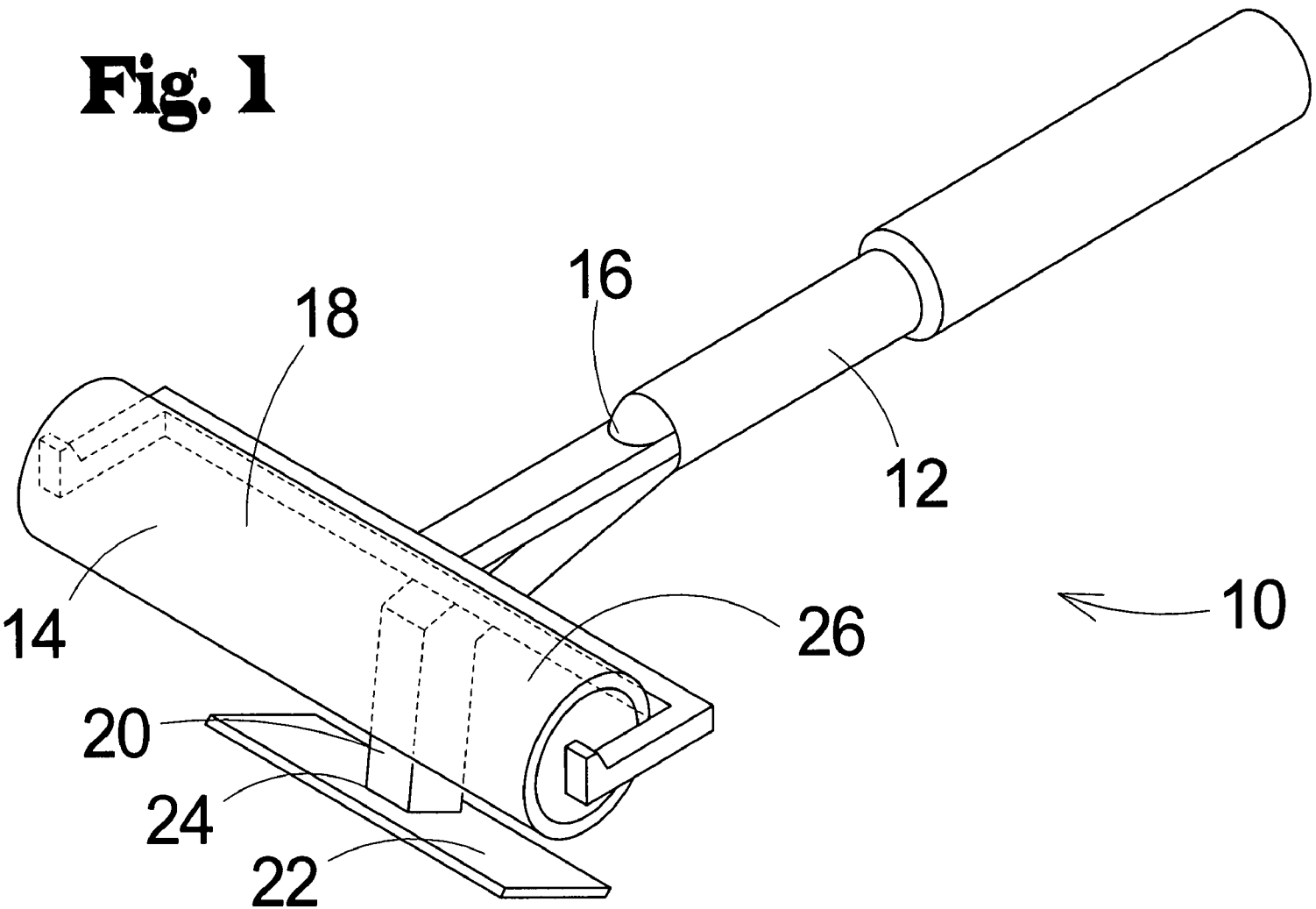
FIG. 1 is a perspective view of a new clothes lint ball removal system according to the present invention.
Figure 2:
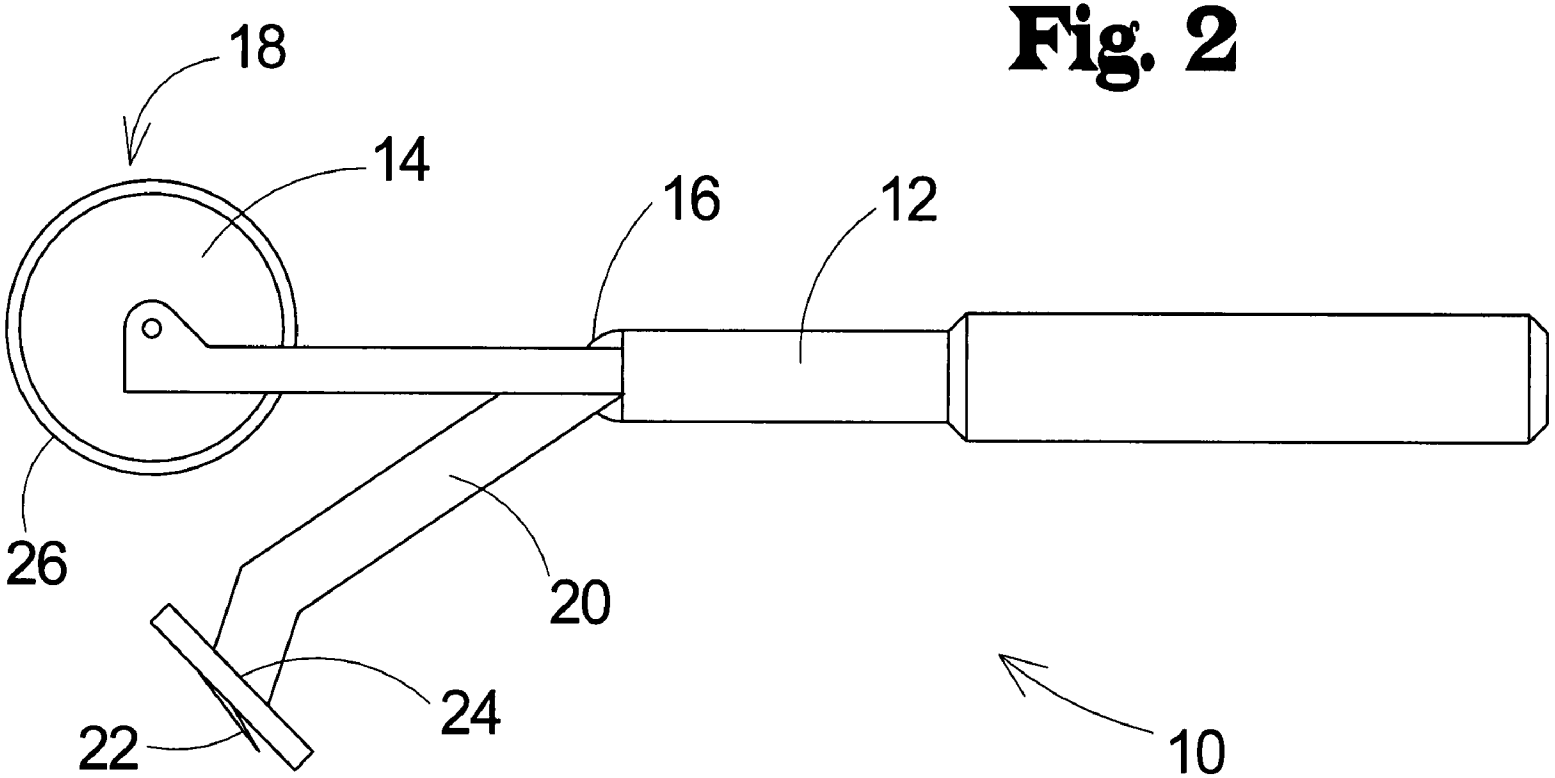
FIG. 2 is a side view of the present invention.

With reference now to the drawings, and in particular to FIGS. 1 and 2 thereof, a new clothes lint ball removal system embodying the principles and concepts of the present invention and generally designated by the reference numeral 10 will be described.

As best illustrated in FIGS. 1 and 2, the clothes lint ball removal system 10 generally comprises a handle member 12 and a roller 14 coupled to an end 16 of the handle member 12. The roller 14 has an adhesive surface 18. An arm 20 extends from the handle member 12 and a razor 22 is coupled to a distal end 24 of the arm 22.

In an embodiment, the adhesive surface 18 of the roller 14 is formed by an adhesive sheet 26. A plurality of layered adhesive sheets 26 may be wrapped around the roller 14 such that an outermost one of the sheets may be removed to reveal a new fully adhesive sheet when the outermost sheet loses adhesion. Alternately, the adhesive surface may be provided by use of materials conventionally known and used for dust removal.

In an embodiment, the arm 20 forms an obtuse angle with the handle member 12 such that the razor 22 is positioned offset from a longitudinal axis of the handle member 12. Thus, the razor may be more easily angled during use to optimize the cutting angle of the blade of the razor.

Most preferably, the roller 14 and the razor 22 are positioned in spaced alignment with each other such that a user can move between using the razor 22 and the roller 14 by rotating the handle member 12 about 180 degrees about the longitudinal axis of the handle member 12.

In use, the user may begin by removing fine hairs and lint by rolling the adhesive surface against a material surface. If needed, the device is then rotated to raze lint balls or similar debris on the material surface. It may be desired to use the adhesive roller again after use of the razor to remove any lint or debris liberated from the material surface by the razor but not actually removed. Alternately, the razor may be used initially and followed by use of the roller if necessary.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. A lint ball removal tool comprising:

(a) a handle member, (b) a roller coupled to an end of the handle member, the roller having an adhesive surface, (c) an arm extending from the handle member, and (d) a razor coupled to a distal end of the arm.

2. The lint ball removal tool of claim 1 wherein the adhesive surface of the roller is formed by an adhesive sheet.

3. The lint ball removal tool of claim 2 wherein the roller includes a plurality of layered adhesive sheets, each adhesive sheet being removable from the roller to facilitate replacement of the adhesive surface of the roller upon loss of adhesion on an outwardly facing surface of an outermost one of the adhesive sheets.

4. The lint ball removal tool of claim 1 wherein the arm forms an obtuse angle with the handle member.

5. The lint ball removal tool of claim 1 wherein the roller and the razor are positioned in spaced alignment with each other such that a user can move between using the razor and the roller by rotating the handle member about 180 degrees about a longitudinal axis of the handle member.

* * * * *